United States Patent [19]

Pruett

[11] 3,982,867

[45] Sept. 28, 1976

[54] CONSTRUCTION DECK ELEVATION GAUGE AND EASY-OUT BOLT ASSEMBLY

[76] Inventor: Vernon E. Pruett, Rte. No. 2, Box 1, Worthington, Ind. 47471

[22] Filed: May 29, 1975

[21] Appl. No.: 581,875

Related U.S. Application Data

[60] Division of Ser. No. 530,063, Dec. 6, 1974, which is a continuation-in-part of Ser. No. 403,282, Oct. 3, 1973, abandoned.

[52] U.S. Cl. ..... 425/171; 249/23; 33/169 R; 33/180 R; 340/265; 340/282; 340/421

[51] Int. Cl.[2] ..... G08B 21/00; B29C 1/00

[58] Field of Search ..... 33/169 RB, 170, 180 R, 33/181 R, 172 E; 340/282, 421, 265; 249/18, 210, 23; 425/171

[56] References Cited

UNITED STATES PATENTS

| | | | |
|---|---|---|---|
| 2,179,658 | 11/1939 | Gallagher | 33/169 B |
| 2,663,944 | 12/1953 | Rumbaugh | 33/169 B |
| 2,914,857 | 12/1959 | Perwas | 33/170 |
| 2,936,526 | 5/1960 | Dupre | 33/170 |
| 3,215,389 | 11/1965 | Williams | 249/210 |
| 3,292,869 | 12/1966 | Beyeler | 33/172 E |
| 3,504,879 | 4/1970 | Strickland | 249/18 |
| 3,594,773 | 7/1971 | Conkle | 340/282 |
| 3,781,999 | 1/1974 | Colangelo | 33/170 |

*Primary Examiner*—Richard E. Aegerter
*Assistant Examiner*—John W. Shepperd
*Attorney, Agent, or Firm*—Jenkins, Hanley & Coffey

[57] ABSTRACT

For use in establishing the prescribed elevation difference between an adjustably movable deck member and a relatively stationary support member, an elevation gauge comprising a case, a contact carrier disposed in the case and guided for vertical movement, a lead screw for moving the contact carrier, a scale carried by the contact carrier to extend vertically upwardly and to cooperate with an indicator pointer carried by the case to indicated the selected vertical position of the contact carrier, a second contact carrier guided for vertical movement on the case, and a signal device for providing an output when the second contact carrier is in a preselected elevational position relative to the first contact carrier. A plunger coupled to the signal device cooperates between the first and second contact carriers, and the case is adapted to rest on one of the members while the said second contact carrier is adapted to rest on the other of said members. A plurality of bolt assemblies is provided for adjustably supporting the deck member on the support member. Each bolt assembly comprises a vertically extending bolt, a hanger for mounting on the support member, with the upper end of the bolt penetrating through the hanger and being rotatable relative to the hanger. A first nut threadedly engages the upper end of the bolt and restrains the bolt against movement downwardly relative to the hanger. A second nut threadedly engages the bolt and supports the deck member, the second nut being prevented from rotating when the bolt rotates. The first nut and the upper end of the bolt are proportioned and designed to be engaged by a tool and rotated together relative to the hanger to raise and lower the deck member to the prescribed height determined by the said gauge.

6 Claims, 6 Drawing Figures

CONSTRUCTION DECK ELEVATION GAUGE AND EASY-OUT BOLT ASSEMBLY

This is a division, of application Ser. No. 530,063 filed Dec. 6, 1974, which is a continuation-in-part application based upon my pending application Ser. No. 403,282 filed Oct. 3, 1973 now abandoned.

This invention relates generally to bridge construction and more particularly to the provision of an elevation gauge for use in establishing the prescribed elevation difference between an adjustably movable deck member and a relatively stationary support member as well as a bolt assembly for adjustably supporting the deck member.

In this application and in the appended claims, the words "deck member" are intended to refer to the type of false deck upon which concrete is poured to establish the floor of a bridge, the false deck being supported on or by support beams. The words "support member" are intended to refer to support members such as said bridge support beams. Further, the term "float" which is used in my parent application Ser. No. 403,282 is used in its broad sense to refer to the type of body which moves, for instance, upwardly and downwardly in another body depending upon outside forces acting thereon. The term "contact carrier", preferred herein, is to be understood to be interchangeable with the word float in such parent application.

Gauges of all types have been suggested by the prior art. U.S. Pat. Nos. 2,452,652 issued Nov. 2, 1948; 2,632,956 issued Mar. 31, 1953; 2,936,526 issued May 17, 1960; and 3,594,773 issued July 20, 1971 were made of record in my parent application Ser. No. 403,282. Reference is made to such prior art and the references cited therein.

My elevation gauge constitutes a significant improvement over the prior art in that it is adapted for a particular use. I am not aware of any prior effort to provide a gauge which is suitable for use in establishing the prescribed elevation difference, for instance, between the adjustably movable false deck of a bridge and the supporting beams of the bridge.

A principal object of my invention, therefore, is to provide an elevation gauge which is used in conjunction with bolt assemblies to establish the prescribed elevation difference between an adjustably movable deck member and a relatively stationary support member such as a support beam. My elevation gauge comprises a case, a contact carrier disposed in the case and guided for vertical movement, selectively adjustable means for moving the contact carrier vertically in the case, scale means and indicator means cooperatively connected to the case and the contact carrier to indicate the selected vertical position of the contact carrier, a second contact carrier guided for vertical movement on the case, and means for providing an output signal when the second contact carrier is in a preselected elevational position relative to the first mentioned contact carrier. The signal means cooperates between the first and second contact carriers and preferably includes battery-operated noise means, the actuating contacts for which are carried respectively on the first and second contact carriers to energize the noise means when the second contact carriers moves in close proximity to the first contact carriers. The case is adapted to rest on one of the members and the said second contact carrier is adapted to rest on the other of said members. That is, the case may be placed upon the deck to rest thereon while the second contact carrier is placed upon the support beam to rest thereon. Then, as the deck is moved vertically relative to the support beam, the second contact carrier and the first contact carrier move relative to each other until they come into contact, at the prescribed elevation of the deck to provide a signal.

Another object of my invention is to provide such a gauge in which the means for moving the first contact carrier includes a lead screw and means for threadedly engaging the contact carrier with the lead screw such that rotation of the lead screw moves the contact carrier.

Another object of my invention is to provide, for use with a gauge, a plurality of bolt assemblies for adjustably supporting the deck member on the support member, each bolt assembly comprising a vertically extending bolt having an upper end portion, lower end portion and intermediate portion. A hanger is provided for mounting on the support member with the upper end portion of the bolt penetrating through the hanger and being rotatable relative to the hanger. The upper end portion of the bolt is threaded, and a first nut threadedly engages the upper end portion to restrain the bolt against movement downwardly relative to the hanger. The intermediate portion of the bolt is threaded and a second nut threadedly engages the intermediate portion to support the deck member thereon. Means for preventing the second nut from rotating when the bolt is rotating is provided such that rotation of the bolt moves the deck member vertically. The upper end portion and the said first nut are proportioned and designed to be engaged by a tool and rotated together relative to the hanger to raise and lower the deck member.

An object of the present invention is to provide an elevation gauge which is used in conjunction with a bolt assembly to indicate a correct predetermined distance between an adjustably movable deck and the flange of the support beam in the least laborious manner, as opposed to methods presently being practiced, for instance, on bridge construction.

Other objects of the present invention are to provide a construction deck elevation gauge which is simple in design, inexpensive to manufacture, rugged in construction, easy to use, and efficient in operation.

These and other objects will be readily evident upon a study of the following specifications and the accompanying drawings wherein.

Figure 1:
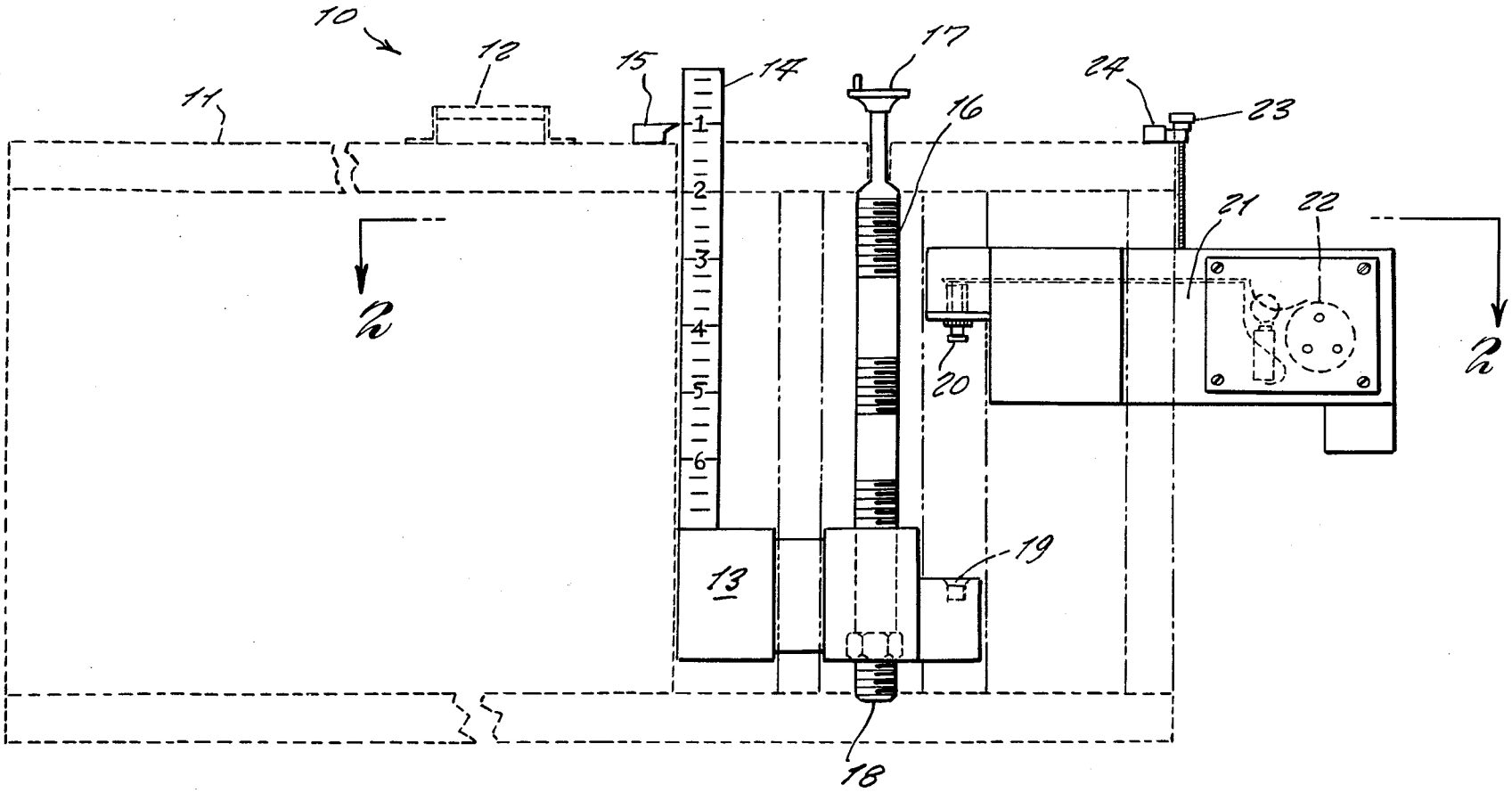
FIG. 1 is a side elevation view of a gauge of the present invention.

Reference is now made to the drawings in detail, and wherein there is shown in FIG. 1 a construction deck elevation gauge 10 comprising an enclosure case 11 provided with a carrying handle 12, the case being approximately 9 inches high. Incorporated within the case 11 is a contact carrier 13 and an inch calibrated rule 14 that protrudes upwardly through the top of the case to be in alignment with an indicator 15 positioned upon the top of the case. The contact carrier is operated by a bolt or lead screw 16 which penetrates through the top of the case and which has a handle 17 mounted thereon. The lower end of the lead screw 16 seats within the bottom of the case as shown at 18, and the contact carrier 13 is provided with means threadedly engaging the lead screw such that rotation of the lead screw raises and lowers the contact carrier 13. The contact carrier includes a plunger seat 19 for association with a buzzer activating plunger 20 on a second contact carrier 21 that protrudes outwardly from the side of the case 11, and which incorporates a battery-operated signal buzzer 22 therewithin. A flexible handle 23 is provided for manually raising and lowering the contact carrier 21, the flexible handle 23 being connectible with a spring catch 24 to hold the contact carrier 21 in a fixed position.

Figure 2:
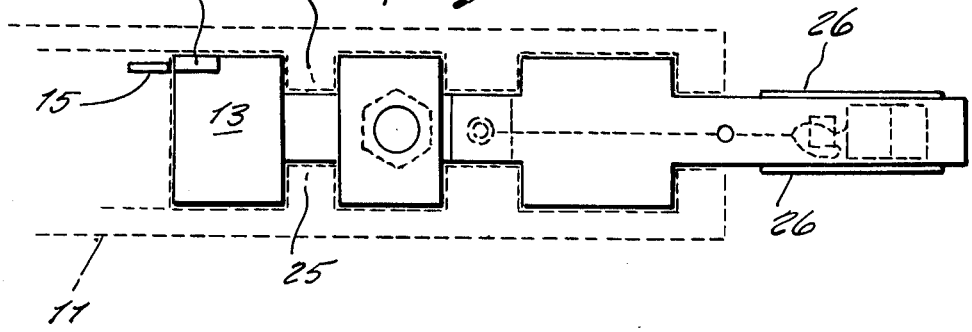
FIG. 2 is a partial plan view of the gauge.

As shown in FIG. 2, guide tracks 25 are provided for guiding the contact carrier 13 for vertical movement. The battery-operated signal buzzer 22 is disposed within the contact carrier 21 between buzzer cover plates 26. The case 11 may be approximately 3 inches in width, two feet in length and 9 inches in height, but these dimensions are merely illustrative, and it will be appreciated that a case of varying dimensions may be constructed within the scope of the present invention.

Figure 3:
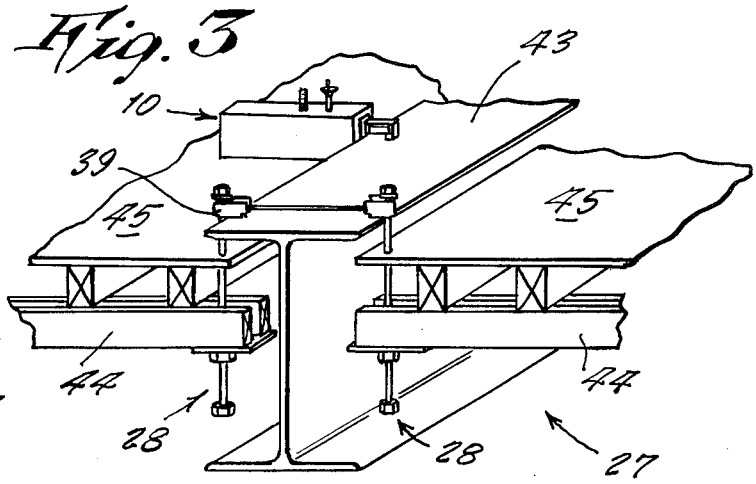
FIG. 3 is a fragmentary perspective view showing the gauge assembly and the bolt assembly of the present invention in operative use on bridge construction.

In FIG. 3, there is shown a practical application of the construction deck elevation gauge 10 with a bridge construction 27.

Figure 4:
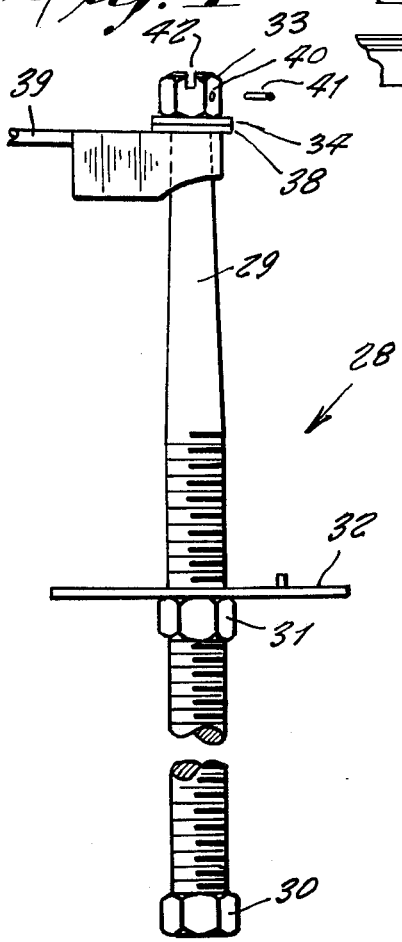
FIG. 4 is a fragmentary side elevation view of a bolt assembly associated with the construction deck.
Figure 5:
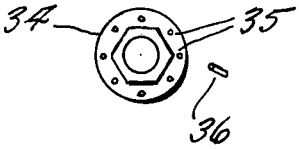
FIG. 5 is a top view of the bolt assembly end.
Figure 6:
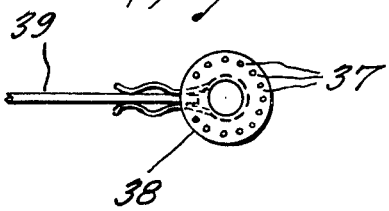
FIG. 6 is a top view of a portion of a hanger.

In FIGS. 4, 5 and 6, there are shown details of an Easy-On Bridge Deck Bolt Assembly with Safety-Lock Nut Assembly 28 which illustratively includes a three-quarter inch diameter bolt 29 that is illustratively two feet in length. This bolt 29 has an upper end portion, a lower end portion, and an intermediate portion. The upper end portion of the bolt 29 is, illustratively, one-half inch in diameter with three-fourths inch of thread with seven threads to the inch. A nut 33 which is also three-fourths inch in axial length is threaded onto the upper end of the bolt. Just below the threaded upper end portion is a length of 3¼ inches of smooth taper, tapering from ½ inch to ¾ inch in diameter. The threading begins at that point for the next 20 inches in length with eight threads to the inch. The bolt assembly 28 is removed after the concrete is poured by placing a socket wrench or crescent wrench on the nut 30 which is threadedly engaged and welded or otherwise rigidly attached to the lower end portion of the bolt. The bolt is turned to the left six revolutions to disengage the bolt from the nut 33. It is noted that the difference in the number of threads to the inch will reduce the pressure on the square washer 32 and nut 31 as it is being removed, thus making it an easy-out bolt.

The nut 31 which is threaded upon the intermediate central portion of the bolt 29 is preferably welded to the square washer plate 32 which may be, for instance, a 4 inch square washer plate resting upon the upper side of the nut 31. The washer plate is provided with an upwardly extending lug which engages into the deck or deck member to provide rotation of the washer plate 32 and nut 31 when the bolt 29 rotates.

A washer 34 is welded or otherwise rigidly secured to the bottom side of the first nut 33, and this washer 34 has a circular arrangement of peripherally spaced apart openings 35 (FIG. 5) extending axially therethrough for the purpose of receiving a locking pin 36 after the openings 35 are aligned with openings 37 of a washer 38 which is welded or otherwise securely fastened to a beam hanger 39.

Two different methods for elevating the deck 45 are shown.

One method is with a kerf or keyway 42 extending transversely through the top of the nut 33 and the upper end portion of the bolt 29 such that, when the kerfs are aligned, a common blade of a tool can be engaged with both the bolt and the nut. The keyway or kerf 42 may be ⅛ of an inch in width and ¼ of an inch in depth and slightly flared at the top. As shown in FIG. 4, the aligned keyways 42 extend across nut 33 and bolt 29 such that a key or blade may be provided inside a socket wrench to fit the aligned keyways 42 and nut 33 to rotate the bolt 29 to adjust the vertical position of the deck. When the socket is removed, the keyway 42 may then be filled with plastic cement or some other such material to prevent concrete penetration.

An alternate method for drivingly connecting the nut 33 to the bolt 29 is with an opening 40 and pin 41. Opening 40 may be ¼ inch from the top of nut 33 and it may extend through one side of nut 33 and completely through the bolt 29. To adjust the deck, a socket with a drilled hole is placed on nut 33 and pin 41 is inserted through the aligned holes of the socket, nut 33, and bolt 29. Then, rotation of the bolt 29 via the socket raises and lowers the deck to the desired elevation. When the desired elevation is obtained, the pin 36 is inserted through one pair of aligned holes 35, 37. When the socket is removed and the pin 41 is removed, the opening 40 may be filled with grease or plastic cement to prevent concrete penetration.

The following is a procedure for use of the gauge and bolt assembly of the present invention. First, a beam hanger 39 is provided which extends transversely across the upper flange of the beam to provide opposite end portions penetrated by bolts 29, the beam being indicated at 43. Then, a bolt 29 extends downwardly from each side of the beam. Then, the nut 31 with the washer 32 thereon is threaded onto the bolt and adjusted to the approximate location required. Then the bolt 29 is slipped through the ledger 44 with the upwardly extending lug on the washer 32 extending into the opening of the ledger. The ledger 44 usually consists of two 2 × 8's nailed together with spacer blocks therebetween. At this point, all raising and lowering of the ledgers 44 and thereby the decks 45 is accomplished by rotating the bolt 29 by locking the nut 33 to the upper end of the bolt and turning the nut.

After the bolt assemblies are connected as shown, the elevation gauge 10 is placed on top of the decking or deck member 45 next to the beam 43 and adjacent a beam hanger 39. The flexible handle 23 is disconnected from a spring catch 24 to lower the contact carrier 21 to rest on the top flange of the beam 43. The rule 14 is raised by raising the contact carrier 13 with the rotatable handle 17 until the prescribed elevation is indicated on the rule 14 as aligned with the indicator 15. The deck 45 is raised or lowered by rotating the nut 33 and bolt 29 until the plunger seat 19 contacts the buzzer plunger 20, thus activating the signal 22 indicating the correct elevation has been made.

Then, the lock pin 36 is inserted through the holes 35 and 37 in the washers 34 and 38 to lock the elevation in place to prevent loosening or turning of nut 33 and thus preventing the ledger or the false work from dropping. When moving the elevation gauge 10, the flexible handle 23 is pulled upwardly and placed in the spring catch 24 to lock the second contact carrier 21 in place.

In bridge construction practices, after the deck 45 is properly adjusted relative to the support beam 43, concrete is poured upon the upper surface of the deck. After the concrete hardens, and it is structurally reinforced by steel, the false work comprising the ledgers 44 and deck 45 are stripped away. This removal of the ledgers 44 and decks 45 is facilitated by my bolt assembly. Particularly, since the upper end portion of the bolt 29 and nut 33 are not drivingly engaged, the bolt can be rotated by gripping the nut 30 on the lower end thereof and twisting the bolt through six revolutions to disengage the nut 33 which may be left in the concrete.

The manner in which bridge decking is presently assembled or adjustably mounted upon beams allows the possibility of the nuts on the support bolts to be loosened unintentionally by workmen by kicking or vibration while they go about their activities on the bridge decking. This movement may cause the nut to be turned to the point that only a few threads are actually supporting the load of the false work. When or if this occurs, the threads will strip and the false work may fall creating an immense danger to the workmen and loss of equipment.

Heretofore, for construction craftsmen to raise or lower the plywood bridge deck to the engineer's predetermined elevation, it was necessary for the workmen to measure the distance between the top of the plywood deck and the top of the bridge deck support beam flange with a carpenter's rule. The raising or lowering of the decking has been accomplished by rotating the top nut on the support bolt while the bottom nut below the false work and support bolt remains in a stationary position due to the weight of the false work.

Prior to pouring of the concrete, the projection of the bolt above the top nut is visually inspected and a determination is made as to whether the projection will leave too great a void in the concrete or will not allow easy removal of the bolt from the concrete. If the projection is determined to be too great, a section of the plywood decking at the support bolt area has to be removed to allow access to the support bolt nut at the undermost side of the false work. The top nut then has to be loosened and the bottom nut tightened simultaneously, thereby lowering the projection of the bolt. If through human error some of the support bolts have not been lowered and the concrete has been poured and cured, the bolts become impossible to remove without breaking them off when the false work is being stripped. Through the process of human error, cumbersome procedures and erroneous readings, the process of calculating and resetting the plywood decking work becomes extremely costly and time-consuming.

My invention, as described above, with the gauge 10 and the bolt assembly 28 permits easy and quick adjustment of the deck levels and easy removal of the bolts after the concrete has been poured and cured. The possibility of the nut 33 being loosened by kicking or vibration is eliminated by use of the pin 36 which penetrates through the openings 35 and 37.

While I have shown the gauge 10 case 11 resting upon the deck 45 with the contact carrier 21 resting upon the upper flange of the support beam 43, it will be appreciated that that relationship might be reversed such that the case 11 might rest upon the beam 43 leaving the contact carrier 21 to rest upon the deck. All sorts of extensions may be connected to the contact carrier 21 as desired because, in some cases, the deck surfaces actually may be higher than the beam surfaces.

I claim:

1. In combination, a bridge structure and an elevation gauge, said bridge structure having an adjustably movable deck member and a relatively stationary support member, said gauge for use in establishing the prescribed elevation difference between said adjustably movable deck member and said relatively stationary support member, the improvement in which said elevation gauge comprises a case, a first contact carrier disposed in said case, means for guiding said first contact carrier for vertical movement in said case, selectively adjustable means for moving said first contact carrier vertically in said case, means for indicating the selected vertical position of said first contact carrier relative to said case, said indicating means including scale means and indicator means cooperatively connected to said case and said first contact carrier, a second contact carrier, means for guiding said second contact carrier for vertical movement on said case, and means for providing an output signal when said second contact carrier is in a pre-selected elevational position relative to said first contact carrier, plunger means for cooperating between said carriers to actuate said signal means, said plunger means being coupled to said signal means, and said case resting on one of said members and said second contact carrier resting on the other of said members.

2. The invention of claim 1 in which said scale means includes a vertically extending ruler attached to said first contact carrier for movement therewith, said indicator means including a pointer attached to said case to cooperate with said ruler.

3. The invention of claim 1 in which said means for moving said first contact carrier includes a lead screw and means for threadedly engaging said contact carrier with said lead screw such that rotation of said lead screw moves said contact carrier.

4. The invention of claim 1 in which said signal means includes battery-operated noise means, the actuating contacts for which are carried on one of said contact carriers to energize said noise means when said second contact carrier moves in close proximity to said first contact carrier.

5. The invention of claim 4 in which said scale means includes a vertically extending ruler attached to said first contact carrier for movement therewith, said indicator means including a pointer attached to said case to cooperate with said ruler.

6. The invention of claim 5 in which said means for moving said first contact carrier includes a lead screw and means for threadedly engaging said contact carrier with said lead screw such that rotation of said lead screw moves said contact carrier.

* * * * *

PO-1050
(5/69)

UNITED STATES PATENT OFFICE
CERTIFICATE OF CORRECTION

Patent No. 3,982,867 Dated September 28, 1976

Inventor(s) Vernon E. Pruett

It is certified that error appears in the above-identified patent and that said Letters Patent are hereby corrected as shown below:

Column 1, line 29, the word "float" should be placed in quotation marks; line 65, "second contact carriers" should be -- second contact carrier --; line 66, "first contact carriers" should be -- first contact carrier --.

Column 3, line 31, "Easy-On" should be -- Easy-Out --; line 61, "provide" should be -- prevent --.

Signed and Sealed this

Thirtieth Day of November 1976

[SEAL]

*Attest:*

RUTH C. MASON
*Attesting Officer*

C. MARSHALL DANN
*Commissioner of Patents and Trademarks*